US009412497B2

(12) United States Patent
Hashimoto et al.

(10) Patent No.: US 9,412,497 B2
(45) Date of Patent: Aug. 9, 2016

(54) CABLE

(71) Applicant: SUMITOMO ELECTRIC INDUSTRIES, LTD., Osaka-shi, Osaka (JP)

(72) Inventors: Satoshi Hashimoto, Kanuma (JP); Yuji Ochi, Kanuma (JP); Takaya Kohori, Kanuma (JP); Takami Sagisaka, Kanuma (JP); Yuhei Mayama, Osaka (JP)

(73) Assignee: SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 14/373,150

(22) PCT Filed: Jan. 18, 2013

(86) PCT No.: PCT/JP2013/050987

§ 371 (c)(1),
(2) Date: Jul. 18, 2014

(87) PCT Pub. No.: WO2013/108895

PCT Pub. Date: Jul. 25, 2013

(65) Prior Publication Data

US 2015/0144375 A1 May 28, 2015

(30) Foreign Application Priority Data

Jan. 19, 2012 (JP) ..... 2012-009373

(51) Int. Cl.
*H01B 7/00* (2006.01)
*H01B 11/02* (2006.01)
(Continued)

(52) U.S. Cl.
CPC ..... *H01B 7/295* (2013.01); *H01B 1/026* (2013.01); *H01B 3/302* (2013.01); *H01B 3/307* (2013.01); *H01B 3/441* (2013.01); *H01B 7/0009* (2013.01); *H01B 13/02* (2013.01)

(58) Field of Classification Search
CPC .... H01B 11/002; H01B 7/295; H01B 7/0208; H01B 11/18; H01B 13/00; H01B 1/02; H01B 1/026; H01B 3/441; H01B 3/30; H01B 3/302; H01B 3/307; H01B 3/445; H01B 3/446; H01B 7/0009; H01B 7/00; H01B 11/1008; H01B 11/20; H01B 11/1091; H01B 11/1895; H01B 11/1808; H01B 11/1834; H01B 11/1813; H01B 13/02; B60R 16/0215; Y10T 29/49123
USPC ..... 174/113 R, 120 R, 128.1, 116, 115, 72 A; 385/101
See application file for complete search history.

(56) References Cited

U.S. PATENT DOCUMENTS 4,362,645 A * 12/1982 Hof ..... G01K 13/002 116/201
5,644,105 A * 7/1997 Castellani ..... G02B 6/4436 156/244.12
5,760,341 A * 6/1998 Laske et al. ..... 174/126.2
(Continued)

FOREIGN PATENT DOCUMENTS

CN 102136317 A 7/2011
CN 102163475 A 8/2011
(Continued)

OTHER PUBLICATIONS

"2007 Automotive Engineering Exposition, Sumitomo Denko Group Tenji Goannai", 2007, p. 10.
(Continued)

*Primary Examiner* — Timothy Thompson
*Assistant Examiner* — Guillermo Egoavil
(74) *Attorney, Agent, or Firm* — Drinker Biddle & Reath LLP

(57) ABSTRACT

An object of the invention is to provide a cable capable of matching exposed dimensions of conductors with a predetermined dimension to perform good processing at the time of distal end processing. In a cable (10) in which a pair of insulated wires (1) each of which is formed by covering a conductor (4) with an insulator (5) is mutually stranded and a periphery of these stranded insulated wires (1) is covered with a sheath (6) made of an inner sheath (2) and an outer sheath (3), the conductor (4) is formed by assembling a plurality of stranded wires (4*a*) each of which is formed by wholly stranding a plurality of wires (4*b*), and by further wholly stranding the stranded wires (4*a*).

3 Claims, 3 Drawing Sheets

(51) Int. Cl.

| | |
|---|---|
| ***H01B 7/295*** | (2006.01) |
| ***H01B 1/02*** | (2006.01) |
| ***H01B 3/30*** | (2006.01) |
| ***H01B 3/44*** | (2006.01) |
| *H01B 13/02* | (2006.01) |

(56) References Cited

U.S. PATENT DOCUMENTS

| | | | | |
|---|---|---|---|---|
| 5,959,245 | A * | 9/1999 | Moe | H01B 11/1808 174/110 F |
| 2010/0025072 | A1* | 2/2010 | Okano | H01B 11/1008 174/115 |
| 2010/0147549 | A1* | 6/2010 | Shiina | 174/113 C |
| 2010/0212933 | A1* | 8/2010 | Hayashishita | H01B 11/1895 174/113 C |
| 2011/0079427 | A1* | 4/2011 | Powale et al. | 174/72 A |
| 2011/0127064 | A1* | 6/2011 | Rivernider et al. | 174/106 R |
| 2011/0174518 | A1* | 7/2011 | Iwasaki et al. | 174/116 |
| 2012/0103658 | A1* | 5/2012 | Amato | H01B 7/2825 174/120 SR |

FOREIGN PATENT DOCUMENTS

| | | | | |
|---|---|---|---|---|
| JP | S61-104922 | U | | 7/1986 |
| JP | S64-20981 | U | | 2/1989 |
| JP | 2002-298663 | A | | 10/2002 |
| JP | 2002298663 | A | * | 10/2002 |
| JP | 2005-166560 | A | | 6/2005 |
| JP | 2007-242264 | A | | 9/2007 |
| JP | 2010-129200 | A | | 6/2010 |
| JP | 2010-146755 | A | | 7/2010 |
| JP | A-2010-198973 | | | 9/2010 |
| JP | 2011-014447 | A | | 1/2011 |
| JP | A-2011-150896 | | | 8/2011 |
| WO | WO-2005/013291 | A1 | | 2/2005 |

OTHER PUBLICATIONS

"2008 Automotive Engineering Exposition, Sumitomo Denko Group Tenji Goannai", 2008. p. 8.

* cited by examiner

CABLE

TECHNICAL FIELD

The present invention relates to a cable having a pair of insulated wires stranded mutually.

BACKGROUND ART

In various control systems such as an antilock brake system (ABS), a cable configured to strand two insulated wires and cover the outer periphery of the stranded insulated wires with a sheath is used as an ABS sensor cable for transmitting a signal generated by a wheel speed sensor.

This kind of known cable is a cable in which two insulated wires each of which is formed by extruding an insulator to coat a conductor with the insulator are stranded in the form of a twisted pair, and then an inner sheath is extruded to coat the outer periphery of the twisted pair with the inner sheath, and then an outer sheath is extruded to coat the outer periphery of the inner sheath with the outer sheath (for example, see Patent Reference 1).

PRIOR ART REFERENCE

Patent Reference

Patent Reference 1: international publication No. 2005/013291

DISCLOSURE OF THE INVENTION

Problems that the Invention is to Solve

In the case of performing distal end processing to the cable described above, the outer sheath and the inner sheath are cut and pulled out in an axial direction. However, since the insulators of the insulated wires are in close contact with the inner sheath, when the outer sheath and the inner sheath are pulled out, the insulators of the insulated wires may be pulled and elongated. Therefore, when the outer sheath and the inner sheath are removed, the lengths of the insulators of the insulated wires become unequal and when the insulators are removed to expose the conductors of the insulated wires later, exposed dimensions do not match with a predetermined dimension and there was fear of poor distal end processing.

An object of the invention is to provide a cable capable of matching exposed dimensions of conductors with a predetermined dimension to perform good processing at the time of distal end processing.

Means for Solving the Problems

A cable of the invention which can solve the above problem is a cable in which a pair of insulated wires each of which is formed by covering a conductor with an insulator is mutually stranded and a periphery of these stranded insulated wires is covered with a sheath made of an inner sheath and an outer sheath, wherein the conductor is formed by assembling a plurality of stranded wires each of which is formed by wholly stranding a plurality of wires, and by further wholly stranding the stranded wires.

In the cable of the invention, it is preferable that an adhesion between the conductor and the insulator is 32 N/35 mm or more.

In the cable of the invention, it is preferable that a ratio of an adhesion between the conductor and the insulator to an adhesion between the insulated wire and the sheath is 0.59 or more.

ADVANTAGE OF THE INVENTION

According to the cable of the invention, multiple fine unevenness are formed on an outer peripheral surface of the conductor by constructing the conductor by assembling the plurality of stranded wires, each of which is formed by wholly stranding the plurality of wires, and by further wholly stranding the stranded wires. Accordingly, the insulator extruded to the periphery of the conductor bites into the unevenness of the surface of the conductor. Also, an area of contact between the conductor and the insulator which coats the periphery of the conductor increases. This increases an adhesion between the conductor and the insulator.

Accordingly, in the case of removing the sheath, the insulator is held in the conductor and elongation of the insulator can be reduced. Consequently, the lengths of the insulators of the insulated wires after removal of the sheath are uniform, and when the insulators are removed to expose the conductors of the insulated wires, exposed dimensions of the conductors can be matched with a predetermined dimension to perform good distal end processing.

BRIEF DESCRIPTION OF THE DRAWINGS

FIG. 2 is a view showing a state of an insulator in the case of removing a sheath.

MODE FOR CARRYING OUT THE INVENTION

An example of an embodiment of a cable according to the invention will hereinafter be described with reference to the drawings.

Figure 1:
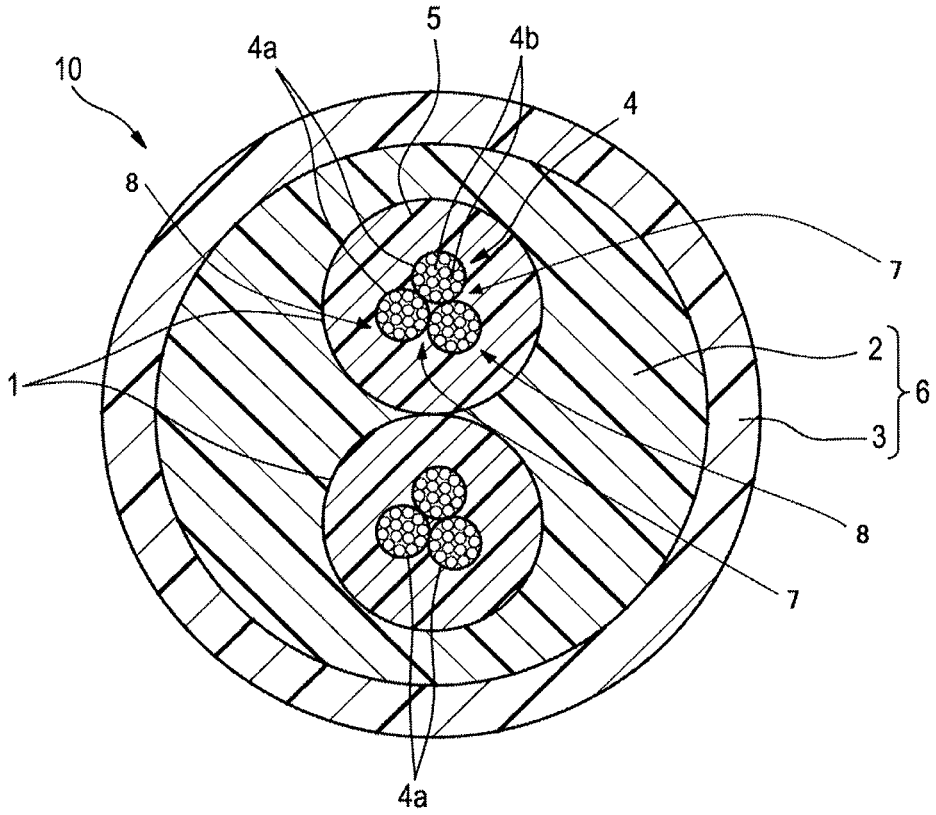
FIG. 1 is a sectional view showing one embodiment of a cable according to the invention.

As shown in FIG. 1, a cable 10 according to the present embodiment has a pair of insulated wires 1.

This cable 10 is used as, for example, an ABS sensor cable for transmitting a signal generated by a wheel speed sensor in various control systems such as an ABS. In addition, the cable 10 can be used as a cable other than the ABS sensor cable.

The insulated wire 1 constructing this cable 10 includes a conductor 4 and an insulator 5 which covers the outer periphery of the conductor 4. The pair of insulated wires 1 is mutually stranded.

The conductor 4 is made of a copper tin alloy, and a cross-sectional area of the conductor 4 is, for example, 0.18 $mm^2$ or more and 0.30 $mm^2$ or less. In addition, the concentration of tin in the copper tin alloy of the conductor 4 is, for example, 0.2 mass percent or more and 0.6 mass percent or less. An annealed copper wire or a hard-drawn copper wire can also be used in the conductor 4.

This conductor 4 is constructed by assembling a plurality of stranded wires 4*a* and wholly stranding the stranded wires 4*a*. Further, the stranded wire 4*a* constructing the conductor 4 is constructed by stranding a plurality of wires 4*b*. That is, the conductor 4 is constructed by assembling the plurality of stranded wires 4*a* formed by wholly stranding the plurality of wires 4*b* and further wholly stranding the stranded wires 4*a*.

The wire 4*b* constructing the stranded wire 4*a* is formed in, for example, an outside diameter of about 0.08 mm, and the stranded wire 4*a* is constructed by wholly stranding, for example, 16 wires 4*b*. Then, the conductor 4 is constructed by stranding, for example, three stranded wires 4*a*. Accordingly, the conductor 4 is constructed of, for example, a total of 48 wires 4*b*, and an outside diameter of the conductor 4 is formed in about 0.82 mm.

The insulator 5 which covers the conductor 4 is formed of, for example, cross-linked flame-retardant polyethylene (PE). An outside diameter of the insulated wire 1, which is an outside diameter of this insulator 5, is formed in about 1.4 mm. Accordingly, a strand outside diameter of a pair of insulated wires 1 stranded mutually is formed in about 2.8 mm.

The periphery of a pair of insulated wires 1 stranded mutually is covered with a sheath 6. The sheath 6 has a two-layer structure made of an inner sheath 2 as an intervenient layer and an outer sheath 3 as a jacket.

The inner sheath 2 is a sheath extruded to coat the periphery of a pair of insulated wires 1, and is formed of, for example, cross-linked flame-retardant polyethylene (PE). The inner sheath 2 also has a function of improving roundness in a transverse cross section of the cable 10. And, an outside diameter of this inner sheath 2 is formed in about 3.4 mm.

The outer sheath 3 is a sheath extruded to coat the periphery of the inner sheath 2, and is formed of, for example, cross-linked flame-retardant thermoplastic polyurethane (TPU). And, an outside diameter of the cable 10, which is an outside diameter of the outer sheath 3, is formed in a small diameter of about 4.0 mm.

The conductor 4 is constructed by wholly stranding the plurality of stranded wires 4*a* each of which is formed by wholly stranding the plurality of wires 4*b*. Accordingly, fine unevenness is formed on an outer peripheral surface of the conductor 4. In FIG. 1, a recess is a spiral groove 7 between the stranded wires 4*a*, and a protrusion is the outermost portion 8 of the stranded wire 4*a*. Consequently, the insulator 5 extruded to coat the periphery of this conductor 4 bites into the unevenness of the periphery of the conductor 4. Then, a contact area of the interface between the insulator 5 and the conductor 4 increases. This increases an adhesion between the conductor 4 and the insulator 5. Accordingly, the adhesion between the conductor 4 and the insulator 5 becomes 32 N/35 mm or more. Then, a ratio of the adhesion between the conductor 4 and the insulator 5 to an adhesion between the insulated wire 1 and the sheath 6 (an adhesion between the insulator 5 and the inner sheath 2) becomes 0.59 or more.

In the case of manufacturing the cable 10 described above, a pair of insulated wires 1 is first mutually stranded and cross-linked flame-retardant polyethylene is extruded to coat the periphery of the stranded insulated wires to thereby form the inner sheath 2. By forming the inner sheath 2, unevenness (stranded corrugation) of a surface on which the insulated wires 1 are stranded is filled to form a round wire shape with substantially a circular cross section.

Next, cross-linked flame-retardant thermoplastic polyurethane is extruded to coat the periphery of the inner sheath 2 to thereby form the outer sheath 3. Accordingly, the pair of insulated wires 1 is coated with the sheath 6 made of the inner sheath 2 and the outer sheath 3 to form the cable 10.

In the case of performing distal end processing to the cable 10, the sheath 6 made of the inner sheath 2 and the outer sheath 3 is first cut in a predetermined length from the end and is pulled out in an axial direction and the insulated wires 1 are exposed. Thereafter, the insulators 5 of the insulated wires 1 exposed are removed to expose the conductors 4 in a predetermined dimension.

Figure 2A:
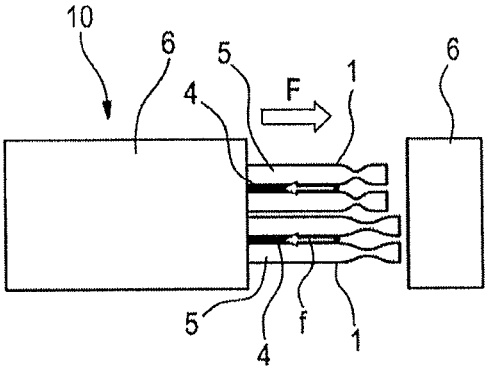
FIGS. 2A and 2B are respectively schematic side views in the end of the cable.

Since the insulators 5 of the insulated wires 1 are in close contact with the inner sheath 2, when the sheath 6 is pulled out in a cable with a conventional structure, a tensile force F by an adhesion to the sheath 6 pulled out is produced in each of the insulators 5 of the respective insulated wires 1 as shown in FIG. 2A. Also, in each of the insulated wires 1, drag f against the tensile force F is produced in each of the insulators 5 by an adhesion to the conductor 4. When an adhesion between the insulator 5 and the conductor 4 is low at this time, the drag f also decreases. Then, when the sum (2f) of the drags f of the two insulated wires 1 is lower than the sum (2F) of the tensile forces (2F>2f), each of the insulators 5 of the respective insulated wires 1 is pulled and elongated by the sheath 6 pulled out, and the lengths of the insulators 5 of the insulated wires 1 may become unequal. When the insulators 5 are removed to expose the conductors 4 of the insulated wires 1 later, exposed dimensions of the conductors 4 do not match with a predetermined dimension to result in poor distal end processing.

According to the cable 10 according to the embodiment, fine unevenness is formed on the outer peripheral surface of the conductor 4 by constructing the conductor 4 by wholly stranding the plurality of stranded wires 4*a* each of which is formed by wholly stranding the plurality of wires 4*b*. Consequently, the insulator 5 bites into the unevenness of the periphery of the conductor 4, and a contact area of the interface between the conductor 4 and the insulator 5 which coats the periphery of this conductor 4 increases, and this can increase an adhesion between the conductor 4 and the insulator 5. Specifically, the adhesion between the conductor 4 and the insulator 5 can be set at 32 N/35 mm or more. Accordingly, a ratio of the adhesion between the conductor 4 and the insulator 5 to an adhesion between the insulated wire 1 and the sheath 6 increases. Specifically, the ratio of the adhesion between the conductor 4 and the insulator 5 to the adhesion between the insulated wire 1 and the sheath 6 can be set at 0.59 or more.

Figure 2B:
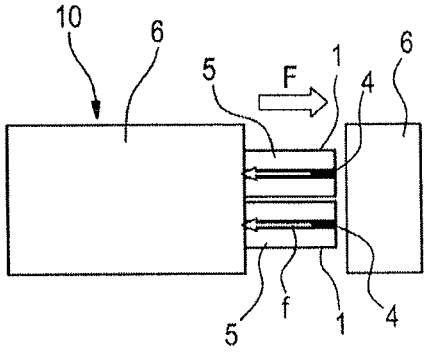

Accordingly, as shown in FIG. 2B, the sum (2f) of drags f of the two insulated wires 1 against the sum (2F) of tensile forces by the adhesion to the conductor 4 increases in the insulator 5 and when the two drags 2f are higher than or equal to the tensile forces 2F (2F ≤2f), elongation of the insulator 5 in the case of removing the sheath 6 can be reduced. Consequently, the lengths of the insulators 5 of the insulated wires 1 after removal of the sheath 6 are uniform, and when the insulators 5 are removed to expose the conductors 4 of the insulated wires 1, exposed dimensions of the conductors 4 can be matched with a predetermined dimension to perform good distal end processing.

EXAMPLE

Various cables 10 (see Table 1) in which the outer periphery of a pair of insulated wires 1 stranded mutually is coated with the sheath 6 were manufactured, and for each of the cables 10, an adhesion was measured and a ratio between adhesions was calculated and elongation was measured and pass/fail determination of distal end processing was made.

TABLE 1

| | Example 1 | Example 2 | Example 3 | Example 4 | Comparative Example 1 | Comparative Example 2 | Comparative Example 3 |
|---|---|---|---|---|---|---|---|
| Cable outside diameter (mm) | 4.0 | 4.0 | 4.3 | 3.4 | 4.0 | 4.0 | 3.4 |
| Conductor size ($mm^2$) | 0.25 | 0.25 | 0.25 | 0.18 | 0.25 | 0.25 | 0.18 |
| Conductor configuration (number of stranded wires/ number of wires/mm) | 3/16/0.08 | 3/16/0.08 | 3/16/0.08 | 3/12/0.08 | 48/0.08 | 48/0.08 | 36/0.08 |
| Conductor outside diameter (mm) | 0.82 | 0.82 | 0.82 | 0.71 | 0.65 | 0.65 | 0.56 |
| Insulator material | Cross-linked flame-retardant PE | Cross-linked flame-retardant PE | Cross-linked flame-retardant PE | Cross-linked flame-retardant PE | Cross-linked flame-retardant PE | Cross-linked flame-retardant PE | Cross-linked flame-retardant PE |
| Insulator outside diameter (mm) | 1.4 | 1.4 | 1.45 | 1.2 | 1.4 | 1.4 | 1.2 |
| Insulator strand outside diameter (mm) | 2.8 | 2.8 | 2.9 | 2.4 | 2.8 | 2.8 | 2.4 |
| Inner sheath material | Cross-linked flame-retardant PE | TPU | TPU | TPU | Cross-linked flame-retardant PE | TPU | TPU |
| Inner sheath outside diameter (mm) | 3.4 | 3.4 | 3.6 | 2.9 | 3.4 | 3.4 | 2.9 |
| Outer sheath material | Cross-linked flame-retardant TPU | TPU | TPU | TPU | Cross-linked flame-retardant TPU | TPU | TPU |

<Cable to be Tested>

Example 1

(1) Cable outside diameter: 4.0 mm (2) Conductor

Conductor size: 0.25 $mm^2$, Conductor configuration: Three stranded wires each of which is formed by stranding 16 wires with an outside diameter of 0.08 mm. Material: copper tin alloy, Strand outside diameter: 0.82 mm (3) Insulator Material: cross-linked flame-retardant polyethylene (PE), Outside diameter: 1.4 mm, Strand outside diameter: 2.8 mm (4) Sheath (4-1) Inner sheath Material: cross-linked flame-retardant polyethylene (PE), Outside diameter: 3.4 mm (4-2) Outer sheath Material: cross-linked flame-retardant thermoplastic polyurethane (TPU), Outside diameter: 4.0 mm Example 2

(1) Cable outside diameter: 4.0 mm (2) Conductor

Conductor size: 0.25 $mm^2$, Conductor configuration: Three stranded wires each of which is formed by stranding 16 wires with an outside diameter of 0.08 mm.

Material: copper tin alloy, Strand outside diameter: 0.82 mm (3) Insulator

Material: cross-linked flame-retardant polyethylene (PE), Outside diameter: 1.4 mm, Strand outside diameter: 2.8 mm (4) Sheath (4-1) Inner sheath Material: thermoplastic polyurethane (TPU), Outside diameter: 3.4 mm (4-2) Outer sheath Material: thermoplastic polyurethane (TPU), Outside diameter: 4.0 mm Example 3

(1) Cable outside diameter: 4.3 mm (2) Conductor

Conductor size: 0.25 $mm^2$, Conductor configuration: Three stranded wires each of which is formed by stranding 16 wires with an outside diameter of 0.08 mm. Material: copper tin alloy, Strand outside diameter: 0.82 mm (3) Insulator Material: cross-linked flame-retardant polyethylene (PE), Outside diameter: 1.45 mm, Strand outside diameter: 2.9 mm (4) Sheath (4-1) Inner sheath Material: thermoplastic polyurethane (TPU), Outside diameter: 3.6 mm (4-2) Outer sheath Material: thermoplastic polyurethane (TPU), Outside diameter: 4.3 mm Example 4

(1) Cable outside diameter: 3.4 mm (2) Conductor

Conductor size: 0.18 $mm^2$, Conductor configuration: Three stranded wires each of which is formed by stranding 12 wires with an outside diameter of 0.08 mm. Material: copper tin alloy, Strand outside diameter: 0.71 mm (3) Insulator Material: cross-linked flame-retardant polyethylene (PE), Outside diameter: 1.2 mm, Strand outside diameter: 2.4 mm (4) Sheath (4-1) Inner sheath Material: thermoplastic polyurethane (TPU), Outside diameter: 2.9 mm (4-2) Outer sheath Material: thermoplastic polyurethane (TPU), Outside diameter: 3.4 mm Comparative Example 1

(1) Cable outside diameter: 4.0 mm (2) Conductor

Conductor size: 0.25 $mm^2$, Conductor configuration: A stranded wire formed by stranding 48 wires with an outside diameter of 0.08 mm, Material: copper tin alloy, Strand outside diameter: 0.65 mm (3) Insulator Material: cross-linked flame-retardant polyethylene (PE), Outside diameter: 1.4 mm, Strand outside diameter: 2.8 mm (4) Sheath (4-1) Inner sheath Material: cross-linked flame-retardant polyethylene (PE), Outside diameter: 3.4 mm (4-2) Outer sheath Material: cross-linked flame-retardant thermoplastic polyurethane (TPU), Outside diameter: 4.0 mm Comparative Example 2

(1) Cable outside diameter: 4.0 mm (2) Conductor

Conductor size: 0.25 $mm^2$, Conductor configuration: A stranded wire formed by stranding 48 wires with an outside diameter of 0.08 mm, Material: copper tin alloy, Strand outside diameter: 0.65 mm (3) Insulator Material: cross-linked flame-retardant polyethylene (PE), Outside diameter: 1.4 mm, Strand outside diameter: 2.8 mm (4) Sheath (4-1) Inner sheath Material: thermoplastic polyurethane (TPU), Outside diameter: 3.4 mm (4-2) Outer sheath Material: thermoplastic polyurethane (TPU), Outside diameter: 4.0 mm Comparative Example 3

(1) Cable outside diameter: 3.4 mm (2) Conductor

Conductor size: 0.18 $mm^2$, Conductor configuration: A stranded wire formed by stranding 36 wires with an outside diameter of 0.08 mm, Material: copper tin alloy, Strand outside diameter: 0.56 mm (3) Insulator Material: cross-linked flame-retardant polyethylene (PE), Outside diameter: 1.2 mm, Strand outside diameter: 2.4 mm (4) Sheath (4-1) Inner sheath Material: thermoplastic polyurethane (TPU), Outside diameter: 2.9 mm (4-2) Outer sheath Material: thermoplastic polyurethane (TPU), Outside diameter: 3.4 mm <Measurement Method and Determination Method>

(1) Measurement of adhesion (1-1) Adhesion between insulated wire and sheath

Figure 3:
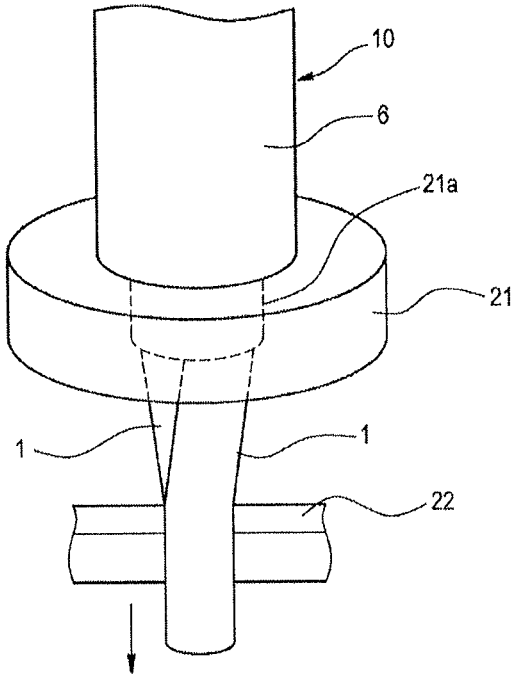
FIG. 3 is a schematic perspective view in a measurement place showing a method for measuring an adhesion between an insulated wire and the sheath.

As shown in FIG. 3, a pair of insulated wires 1 exposed from the end of the cable 10 in which the length of the sheath 6 is set at 35 mm is inserted into an insertion hole 21*a* formed in a die 21, and the die 21 is abutted on an end face of the sheath 6. The distal ends of the pair of insulated wires 1 are clamped by a clamp 22, and the clamp 22 is pulled in a direction (direction of an arrow in FIG. 3) separated from the die 21. Accordingly, the insulated wires 1 are pulled out of the sheath 6 over the length of 35 mm. The maximum force at this time is measured as an adhesion. In addition, a pull-out speed in the case of pulling the insulated wires 1 out of the sheath 6 is set at 100 mm/minute.

(1-2) Adhesion Between Conductor and Insulator

Figure 4:
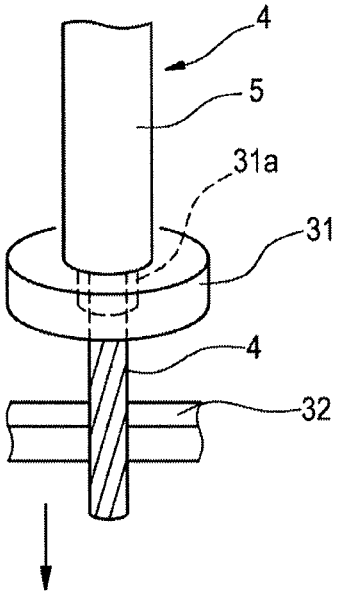
FIG. 4 is a schematic perspective view in a measurement place showing a method for measuring an adhesion between a conductor and the insulator.

As shown in FIG. 4, the conductor 4 exposed from the end of the insulated wire 1 in which the length of the insulator 5 is set at 35 mm is inserted into an insertion hole 31*a* formed in a die 31, and the die 31 is abutted on an end face of the insulator 5. The distal end of the conductor 4 is clamped by a clamp 32, and the clamp 32 is pulled in a direction (direction of an arrow in FIG. 4) separated from the die 31. Accordingly, the conductor 4 is pulled out of the insulator 5 over the length of 35 mm. The maximum force at this time is measured as an adhesion. In addition, a pull-out speed in the case of pulling the conductor 4 out of the insulator 5 is set at 100 mm/minute.

(1-3) Ratio Between Adhesions

A ratio (adhesion 2 to adhesion 1) of an adhesion (adhesion 2) between the conductor 4 and the insulator 5 to an adhesion (adhesion 1) between the insulated wire 1 and the sheath 6 is calculated.

(2) Elongation Measurement

An elongation dimension of the insulator 5 in the case of exposing the insulated wire 1 by simultaneously removing the inner sheath 2 and the outer sheath 3 constructing the sheath 6 is measured.

(3) Pass/Fail Determination

The case where elongation of the insulator 5 in the case of exposing the insulated wire 1 by simultaneously removing the inner sheath 2 and the outer sheath 3 constructing the sheath 6 is 1 mm or less is regarded as a pass (O), and the case where the elongation of the insulator 5 exceeds 1 mm is regarded as a fail (X).

(Evaluation Test Result)

Table 2 shows the measurement results and determination results described above.

TABLE 2

| | Example 1 | Example 2 | Example 3 | Example 4 | Comparative Example 1 | Comparative Example 2 | Comparative Example 3 |
|---|---|---|---|---|---|---|---|
| Adhesion 1 (N/35 mm) | 60 | 63 | 61 | 53 | 60 | 58 | 53 |
| Adhesion 2 (N/35 mm) | 37 | 37 | 41 | 32 | 20 | 19 | 17 |
| Ratio between adhesions | 0.61 | 0.59 | 0.67 | 0.60 | 0.33 | 0.33 | 0.32 |
| Elongation of insulator (mm) | 0 to 0.3 | 0.3 to 0.5 | 0 to 0.2 | 0 to 0.3 | 1.0 to 1.2 | 1.0 to 1.5 | 1.5 to 2.0 |
| Determination (≤1 mm) | ○ | ○ | ○ | ○ | X | X | X |

Examples 1 to 4

In Example 1, an adhesion (adhesion 1) between the insulated wire 1 and the sheath 6 was 60 N/35 mm. Also, an adhesion (adhesion 2) between the conductor 4 and the insulator 5 was 37 N/35 mm. Then, a ratio (adhesion 2 to adhesion 1) between these adhesions was 0.61. Also, an elongation dimension of the insulator 5 in the case of exposing the insulated wire 1 by simultaneously removing the inner sheath 2 and the outer sheath 3 was 0 mm to 0.3 mm.

In Example 2, the adhesion (adhesion 1) between the insulated wire 1 and the sheath 6 was 63 N/35 mm. Also, the adhesion (adhesion 2) between the conductor 4 and the insulator 5 was 37 N/35 mm. Then, the ratio (adhesion 2 to adhesion 1) between these adhesions was 0.59. Also, the elongation dimension of the insulator 5 in the case of exposing the insulated wire 1 by simultaneously removing the inner sheath 2 and the outer sheath 3 was 0.3 mm to 0.5 mm.

In Example 3, the adhesion (adhesion 1) between the insulated wire 1 and the sheath 6 was 61 N/35 mm. Also, the adhesion (adhesion 2) between the conductor 4 and the insulator 5 was 41 N/35 mm. Then, the ratio (adhesion 2 to adhesion 1) between these adhesions was 0.67. Also, the elongation dimension of the insulator 5 in the case of exposing the insulated wire 1 by simultaneously removing the inner sheath 2 and the outer sheath 3 was 0 mm to 0.2 mm.

In Example 4, the adhesion (adhesion 1) between the insulated wire 1 and the sheath 6 was 53 N/35 mm. Also, the adhesion (adhesion 2) between the conductor 4 and the insulator 5 was 32 N/35 mm. Then, the ratio (adhesion 2 to adhesion 1) between these adhesions was 0.60. Also, the elongation dimension of the insulator 5 in the case of exposing the insulated wire 1 by simultaneously removing the inner sheath 2 and the outer sheath 3 was 0 mm to 0.3 mm.

Thus, in all of Examples 1 to 4, the adhesion between the conductor 4 and the insulator 5 became high values (high values of 32 N/35 mm or more) and the ratios between the adhesions became 0.59 or more.

And, in Examples 1 to 4, the elongation dimensions of the insulator 5 in the case of exposing the insulated wire 1 by simultaneously removing the inner sheath 2 and the outer sheath 3 were 1 mm or less, and all were regarded as a pass (O).

Comparative Examples 1 to 3

In Comparative Example 1, an adhesion (adhesion 1) between the insulated wire 1 and the sheath 6 was 60 N/35 mm. Also, an adhesion (adhesion 2) between the conductor 4 and the insulator 5 was 20 N/35 mm. Then, a ratio (adhesion 2 to adhesion 1) between these adhesions was 0.33. Also, an elongation dimension of the insulator 5 in the case of exposing the insulated wire 1 by simultaneously removing the inner sheath 2 and the outer sheath 3 was 1.0 mm to 1.2 mm.

In Comparative Example 2, the adhesion (adhesion 1) between the insulated wire 1 and the sheath 6 was 58 N/35 mm. Also, the adhesion (adhesion 2) between the conductor 4 and the insulator 5 was 19 N/35 mm. Then, the ratio (adhesion 2 to adhesion 1) between these adhesions was 0.33. Also, the elongation dimension of the insulator 5 in the case of exposing the insulated wire 1 by simultaneously removing the inner sheath 2 and the outer sheath 3 was 1.0 mm to 1.5 mm.

In Comparative Example 3, the adhesion (adhesion 1) between the insulated wire 1 and the sheath 6 was 53 N/35 mm. Also, the adhesion (adhesion 2) between the conductor 4 and the insulator 5 was 17 N/35 mm. Then, the ratio (adhesion 2 to adhesion 1) between these adhesions was 0.32. Also, the elongation dimension of the insulator 5 in the case of exposing the insulated wire 1 by simultaneously removing the inner sheath 2 and the outer sheath 3 was 1.5 mm to 2.0 mm.

Thus, in all of Comparative Examples 1 to 3, the adhesion between the conductor 4 and the insulator 5 became low values (values lower than 32 N/35 mm) and the ratios between the adhesions became lower than 0.59.

And, in Comparative Examples 1 to 3, the elongation dimensions of the insulator 5 in the case of exposing the insulated wire 1 by simultaneously removing the inner sheath 2 and the outer sheath 3 exceeded 1 mm, and all were regarded as a fail (X).

The invention has been described in detail with reference to the specific embodiment, but it is apparent to those skilled in the art that various changes or modifications can be made without departing from the spirit and scope of the invention.

The present application is based on Japanese patent application (patent application No. 2012-009373) filed on Jan. 19, 2012, and the contents of the patent application are hereby incorporated by reference.

DESCRIPTION OF REFERENCE NUMERALS AND SIGNS

1: INSULATED WIRE
2: INNER SHEATH
3: OUTER SHEATH
4: CONDUCTOR
4*a:* STRANDED WIRE
4*b:* WIRE
5: INSULATOR
6: SHEATH
10: CABLE

The invention claimed is:

1. A cable comprising:

a pair of insulated wires each of which is formed by covering a conductor with an insulator is mutually stranded and a periphery of these stranded insulated wires is covered with a sheath made of an inner sheath and an outer sheath, wherein the conductor is formed by assembling a plurality of stranded wires each of which is formed by wholly stranding a plurality of wires, and by further wholly stranding the stranded wires, wherein the insulator is in contact with the conductor, and wherein a ratio of an adhesion between the conductor and the insulator to an adhesion between the insulated wire and the sheath is 0.59 or more.

2. The cable as claimed in claim 1, wherein an adhesion between the conductor and the insulator is 32 N/35 mm or more.

3. The cable as claimed in claim 2, wherein the insulator comprises polyethylene and the inner sheath comprises polyethylene or thermoplastic polyurethane.

* * * * *